US011801437B2

(12) United States Patent
Kent

(10) Patent No.: US 11,801,437 B2
(45) Date of Patent: Oct. 31, 2023

(54) MOTOR ASSEMBLY

(71) Applicant: FASTBOARD PTY LTD, Kewdale (AU)

(72) Inventor: Raine Kent, Nedlands (AU)

(73) Assignee: FASTBOARD PTY LTD, Kewdale (AU)

( * ) Notice: Subject to any disclaimer, the term of this patent is extended or adjusted under 35 U.S.C. 154(b) by 108 days.

(21) Appl. No.: 17/380,367

(22) Filed: Jul. 20, 2021

(65) Prior Publication Data

US 2021/0394040 A1 Dec. 23, 2021

(30) Foreign Application Priority Data

May 20, 2020 (AU) ..... 2020100797

(51) Int. Cl.
*A63C 17/12* (2006.01)
*A63C 17/01* (2006.01)

(52) U.S. Cl.
CPC ..... *A63C 17/12* (2013.01); *A63C 17/014* (2013.01); *A63C 2203/12* (2013.01)

(58) Field of Classification Search
CPC .... A63C 17/12; A63C 17/014; A63C 2203/12
See application file for complete search history.

(56) References Cited

U.S. PATENT DOCUMENTS

| | | | | |
|---|---|---|---|---|
| 4,143,728 | A * | 3/1979 | Shiber | A63C 17/18 180/181 |
| 2014/0225419 | A1* | 8/2014 | Bonten | F16C 35/063 301/5.7 |
| 2017/0361204 | A1* | 12/2017 | Bartlett | F16C 33/20 |
| 2018/0015353 | A1* | 1/2018 | Green | A63C 17/226 |
| 2018/0104567 | A1* | 4/2018 | Treadway | A63C 17/265 |
| 2018/0236346 | A1* | 8/2018 | Kluge | A63C 17/223 |
| 2019/0240563 | A1* | 8/2019 | Viera | A63C 17/015 |
| 2020/0009446 | A1* | 1/2020 | Anning | A63C 17/015 |

FOREIGN PATENT DOCUMENTS

| | | | |
|---|---|---|---|
| AU | 2019264570 | A1 | 3/2020 |
| AU | 2020104268 | B4 | 7/2021 |

* cited by examiner

*Primary Examiner* — Brian L Swenson
(74) *Attorney, Agent, or Firm* — MARSHALL, GERSTEIN & BORUN LLP

(57) ABSTRACT

A motor assembly for a transport vehicle (such as a skateboard) having at least one wheel for rotating about a shaft having an end distal to the wheel and an end proximal to the wheel, the motor assembly comprising a stator fixed to the shaft, and a motor bell surrounding the shaft at the location of the stator, wherein the motor bell comprises a first end being adapted to be attached to the wheel for transferring rotational movement of the motor bell to the wheel, and a second end surrounding the shaft at the location of the end distal to the wheel, wherein the second end of the motor bell is a free end permitting removal of the motor bell during removal of the wheel. The motor bell being adapted to permit airflow therethrough for cooling of the motor assembly.

15 Claims, 12 Drawing Sheets

MOTOR ASSEMBLY

TECHNICAL FIELD

The present invention relates to transport vehicles and motor assemblies thereof.

The invention has been devised particularly, although not necessarily solely, in relation to personal transport vehicles such as skateboards and motor assemblies for driving of the skateboards wheels.

BACKGROUND ART

The following discussion of the background art is intended to facilitate an understanding of the present invention only. The discussion is not an acknowledgement or admission that any of the material referred to is or was part of the common general knowledge as at the priority date of the application.

Motorised skateboards have been becoming increasingly popular in particular due to advances in electric motor miniaturisation permitting driving the wheels of the skateboards with motors contained within the wheel hubs.

However, the conventional bearing assemblies for skateboards utilise a bulky enclosed motor assembly comprising of four or more deep groove ball bearings as detailed in FIG. 1. Thus, the current wheel hub or wheel bearing assemblies for skateboards utilising traditional bearing assemblies have increased friction through additional bearing contact points and reduced airflow resulting that the motors heat up to relative high temperatures compromising proper functioning of the motors as well as reducing the operating life of the motors used in conventional skateboards.

Furthermore, disassembly of the electric motors of conventional skateboards is particularly cumbersome. In fact, FIG. 1 shows a conventional arrangement for a direct drive skateboard electric motor. As shown in FIG. 1 there are (1) two smaller deep grove ball bearings on the left side used to support the wheel, and (2) on the right side there are two deep grove ball bearings used to support the motor bell. This particular arrangement results in that the wheel incorporating the bearings is one assembly and the motor assembly is another assembly separate from the wheel. The consequences of this, when removing the wheel, is that the motor assembly will not be removed, requiring a further step to be undertaken for removing the motor assembly.

It is against this background that the present invention has been developed.

SUMMARY OF INVENTION

According to a first aspect of the invention there is provided a motor assembly for a transport vehicle having at least one wheel for rotating about a shaft having an end distal to the wheel and a proximal end to the wheel, the motor assembly comprising a stator fixed to the shaft and a motor bell surrounding the shaft at the location of the stator, wherein the motor bell comprises a first end being adapted to be attached the wheel for transferring rotational movement of the motor bell to the wheel, and a second end surrounding the shaft at the location of the end distal to the wheel, wherein the second end of the motor bell is a free end permitting removal of the motor bell during removal of the wheel.

Preferably, the first and second end of the motor bell comprise open ends permitting air flow therethrough.

Preferably, the motor assembly further comprises a drive collar having a first end adapted to be attached to the first open end of the motor bell, and a second end adapted to be attached to the wheel.

Preferably, the drive collar comprise a base plate and a plurality of extensions extending from the base plate, the base plate being adapted for attachment to the first end of the motor bell and the extensions being adapted to be attached to the wheel.

Preferably, the drive collar is attached to the first end of the motor bell via a cap being adapted to permit air flow through the first end of the motor bell.

Preferably, the cap comprising a base ring and a fastening structure adapted to permit airflow through the first end of the motor bell.

Preferably, there is provided a first bearing assembly surrounding the shaft at the location of the joint of the fastening structure and the first end of the drive collar.

Preferably, the fastening structure comprises an opening and the first end of the drive collar comprises another opening, the openings defining a passage for receiving the bearing assembly.

Preferably, the bearing assembly comprises a needle bearing assembly.

Preferably, there is provided a second bearing assembly surrounding the shaft at a location within the wheel.

Preferably, the bearing assembly comprises at least one angular contact ball bearings.

Preferably, the motor assembly further comprises a rear plate being adapted to receive the second end of the motor bell.

Preferably, the rear plate comprises openings to allow air flow therethrough.

Preferably, the transport vehicle comprises a skateboard comprising a truck having one or more shafts Preferably, each shaft comprises a motor assembly having a wheel attached thereto.

According to a second aspect of the invention there is provided a motor bell of a motor assembly for a transport vehicle having at least one wheel for rotating about a shaft having an distal end with respect to the wheel and a proximal end with respect to the wheel, the motor assembly comprising a stator fixed to the shaft, the motor bell surrounding the shaft at the location of the stator, wherein the motor bell comprises a first end being adapted to be attached the wheel for transferring rotational movement of the motor bell to the wheel, and a second end surrounding the shaft at the location of the end distal to the wheel, wherein the second end of the motor bell is a free end permitting removal of the motor bell during removal of the wheel.

Preferably, the first end comprising a cap being adapted to permit air flow through the first end of the motor bell and the cap comprising a fastening structure comprises an opening adapted to receive at least a portion of a bearing assembly.

Preferably, the bearing assembly comprises a needle bearing assembly.

Preferably, the transport vehicle comprises a skateboard comprising a truck having at least one shaft.

According to a third aspect of the invention there is provided a transport vehicle having one or more shafts, and one or more motor assemblies having each one wheel for rotating about the shafts having an end distal to the wheel and a proximal end to the wheel, the motor assembly comprising a stator fixed to the shaft and a motor bell surrounding the shaft at the location of the stator, wherein the motor bell comprises a first end being adapted to be attached the wheel for transferring rotational movement of the motor bell to the wheel, and a second end surrounding the shaft at the location of the end distal to the wheel, wherein the second end of the motor bell is a free end permitting removal of the motor bell during removal of the wheel.

Preferably, the transport vehicle comprises a skateboard comprising a truck having at least one shaft.

BRIEF DESCRIPTION OF THE DRAWINGS

Further features of the present invention are more fully described in the following description of several non-limiting embodiments thereof. This description is included solely for the purposes of exemplifying the present invention. It should not be understood as a restriction on the broad summary, disclosure or description of the invention as set out above. The description will be made with reference to the accompanying drawings in which.

DESCRIPTION OF EMBODIMENT(S)

Figure 1:
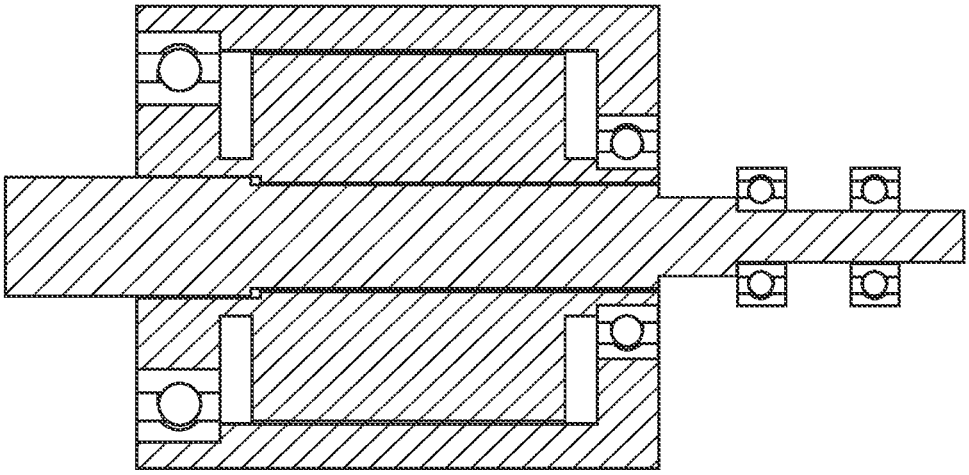
Fig. 1 Prior Art
FIG. 1 is a cross-sectional view of a particular arrangement of a conventional motor assembly for a direct drive system for skateboards.
Figure 2:
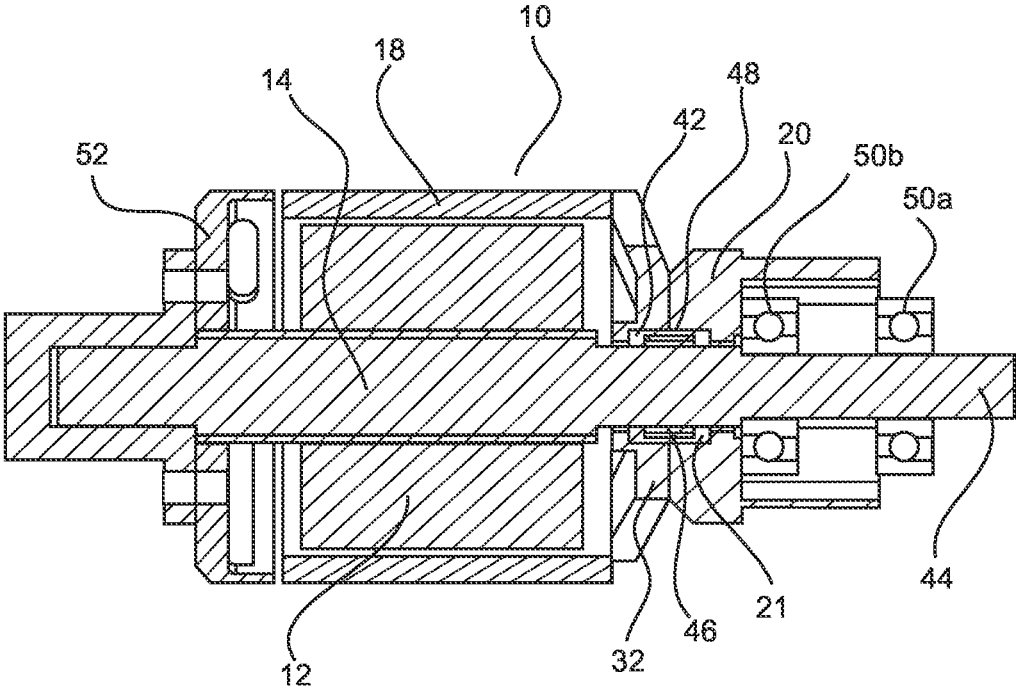
FIG. 2 is a cross-sectional view of a particular arrangement of a motor assembly in accordance with the present embodiment of the invention for a direct drive system for skateboards.

FIG. 2 is a cross-sectional view of a particular arrangement of a motor assembly 10 in accordance with the present embodiment of the invention for a direct drive system for skateboards.

As shown in FIG. 2, the motor assembly 10 comprises a stator 12 fixed to the axle 14 of the truck 16 (see FIG. 3) and a motor bell 18 comprising magnetic material for driving the rotational movement of the motor bell 18 while an electric current flows through the stator.

Figure 7:
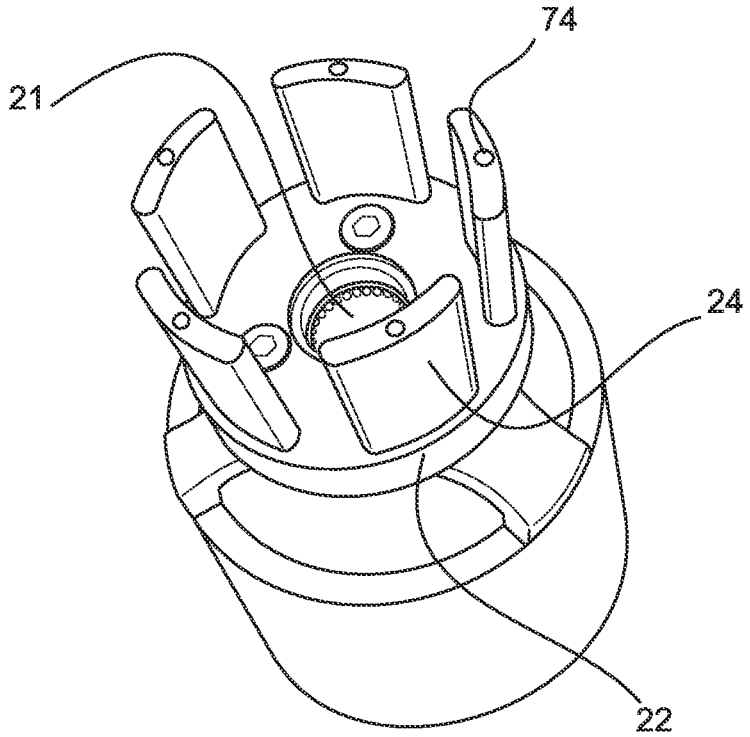
Figure 11:
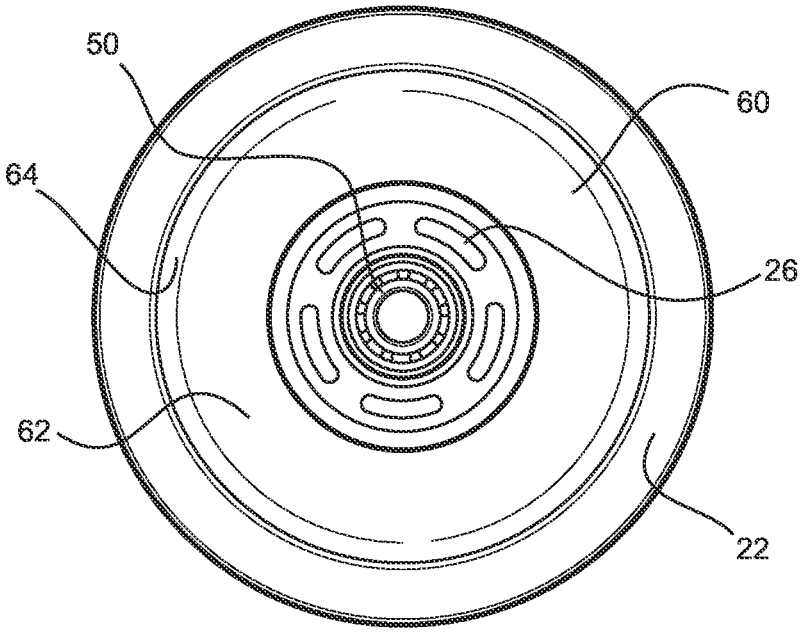
FIG. 11 is a plan view of the inner end of a wheel.
Figure 12:
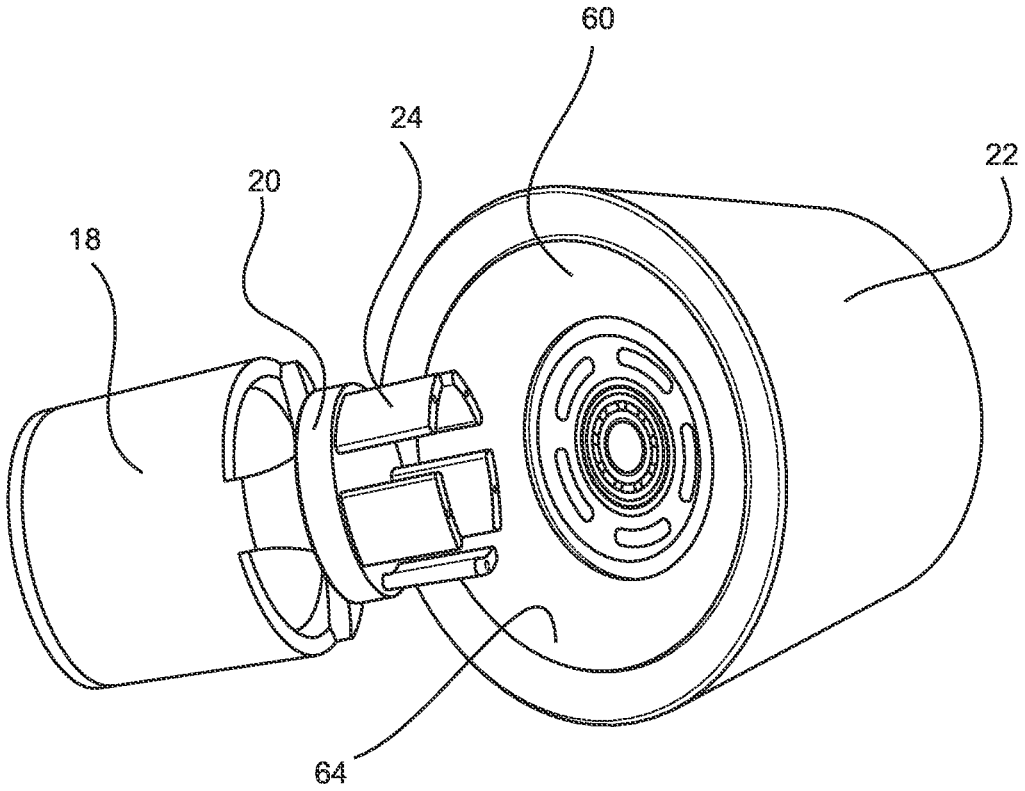
FIG. 12 is a top perspective view illustrating mounting of the motor assembly onto the wheel.
Figure 13:
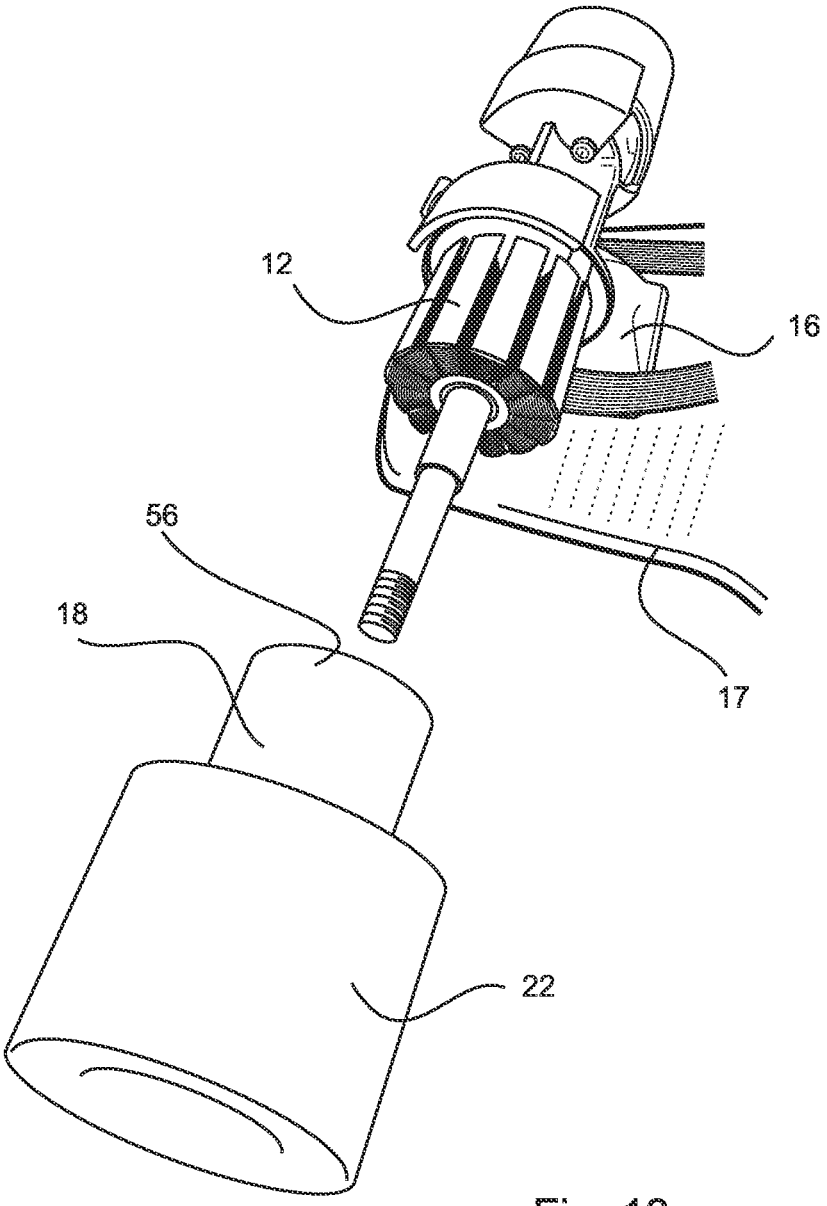
FIG. 13 illustrates mounting of the motor assembly with a wheel mounted thereon prior attachment to the truck.

Further, a drive collar 20 is attached to the motor bell 18. The drive collar 20 is adapted to receive the wheel 22. In particular, as shown in, for example, FIG. 7, the drive collar 20 comprise a base plate 22 and a plurality of extensions 24 extending from the base plate 22 at a location adjacent the outer periphery of the base plate 22. The extensions 24 are arranged in a spaced apart relationship with respect to each other. Each extension 24 has a curved configuration in order for the extensions 24 to be received within the apertures 26 of the wheel 22 as shown in FIGS. 11 and 12.

Figure 4:
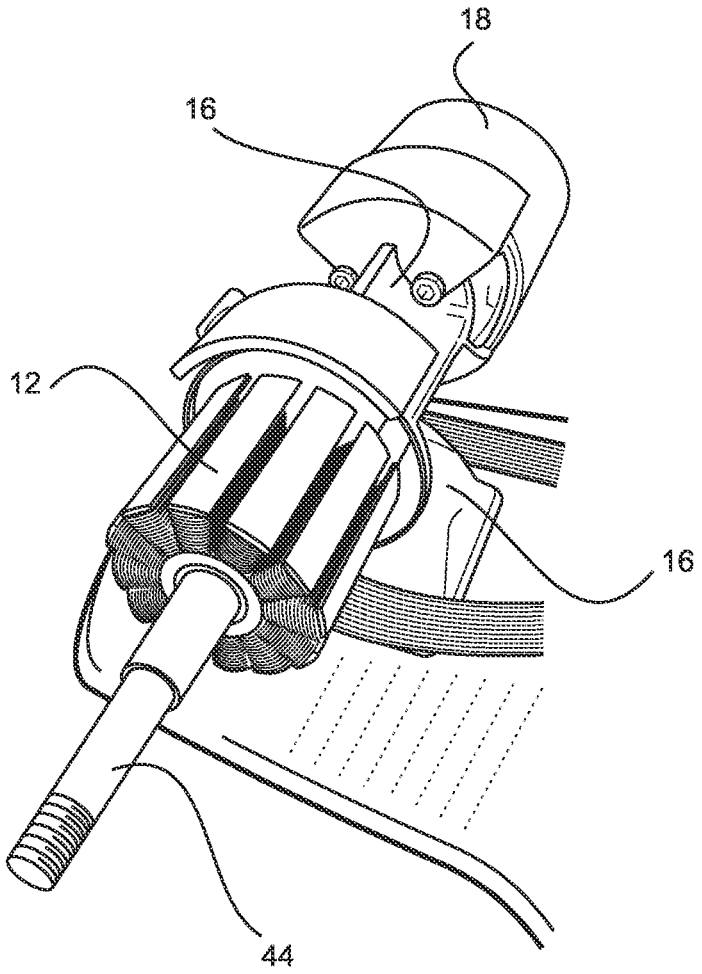
FIG. 4 is a top front perspective view of the truck shown in FIG. 3 with one wheel and motor assembly removed.
Figure 5:
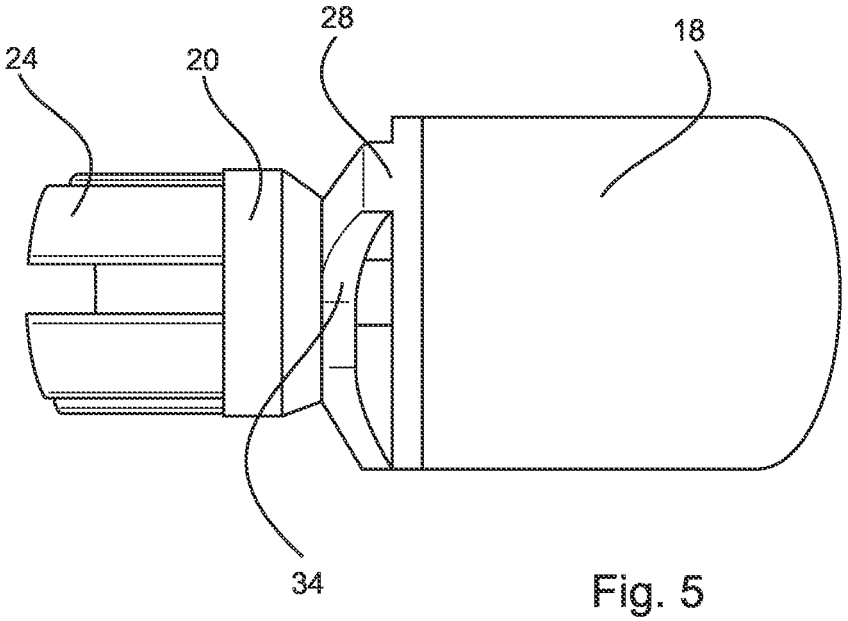
FIGS. 5 to 8 are, respectively, side, perspective and top views of a particular arrangement of the motor assembly in accordance with the present embodiment of the invention

The drive collar 20 comprises an opening 21 to allow the axle 44 of the truck 16 (see FIG. 4) to traverse the drive collar 20.

As mentioned above the drive collar 20 is attached to the motor bell 18. For this the motor bell 18 comprises a cap 28. The cap 28 is adapted to allow air flow through the motor assembly 10 during operation of the motor assembly 10.

Figure 6:
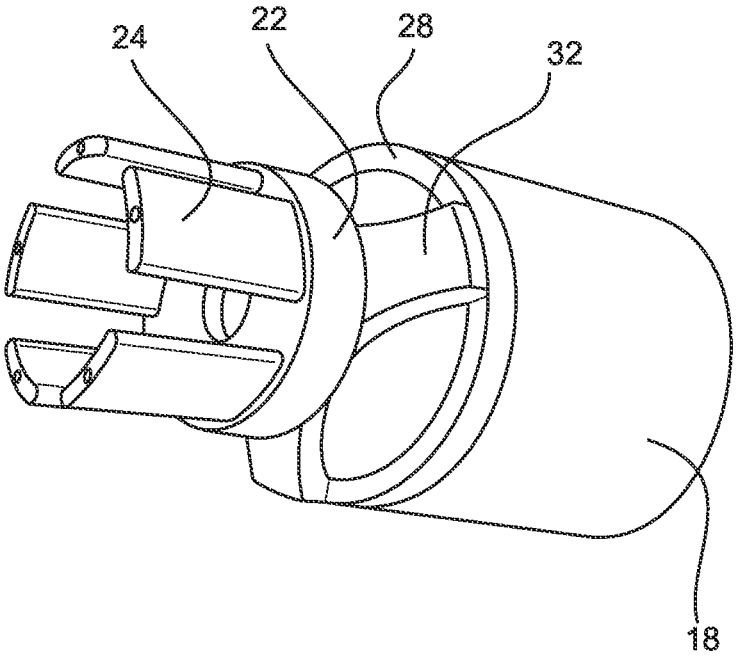

In the particular arrangement shown in the figures, the cap 28 comprises a base ring 30 and a fastening structure 32 covering the base ring 30 as shown in FIG. 6. The fastening structure 32 is configured in such a manner that the base plate 22 of the drive collar 20 may be attached to the fastening structure 32 as shown in FIGS. 6 and 8.

Figure 8:
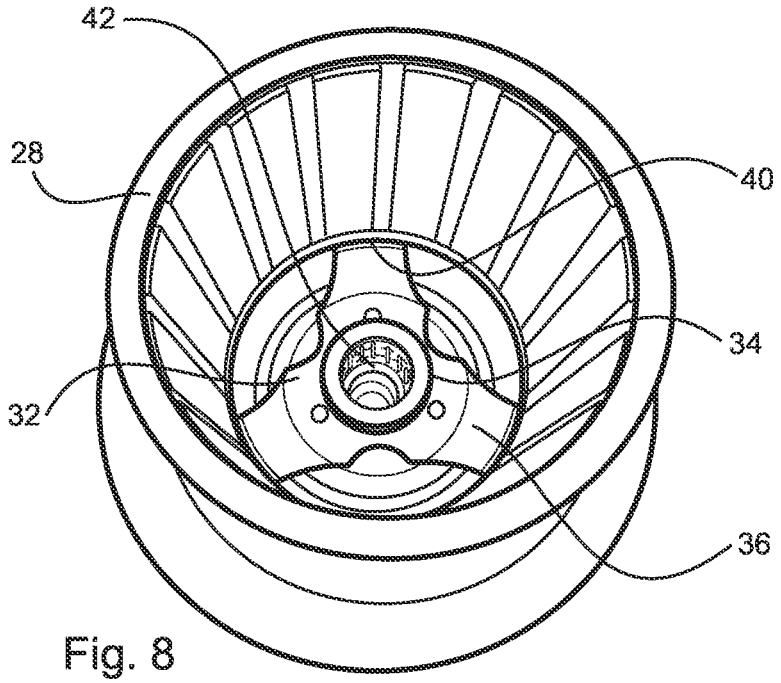

As shown in FIG. 8, the fastening structure 32 comprises a body having a centre section 34 and arms 36 extending from the centre section 34 with the distal ends 38 attached to the rim 40 of the motor bell 18.

Further, as shown in FIG. 8, the fastening structure 32 comprises an opening 42 to allow the axle 44 of the truck 16 (see FIG. 4) to traverse the motor bell 18.

While the motor bell 18 and the drive collar 10 are attached to each other, the opening 42 of the motor bell 18 and the opening 21 of the drive collar 20 coincide with each other defining a passage 46. The passage 46 comprises a bearing assembly 48 such as a needle bearing assembly 48 as can be seen in FIG. 2.

Figure 9:
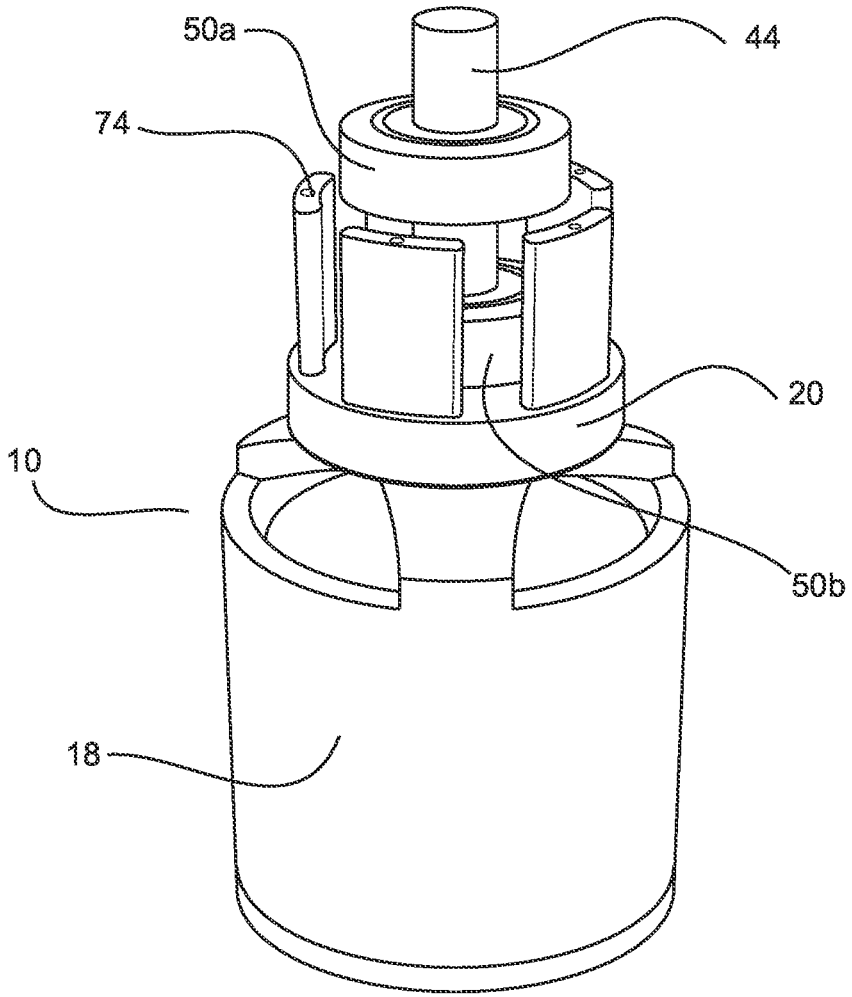
FIG. 9 is a side perspective view of a particular arrangement of the motor assembly in accordance with the present embodiment of the invention mounted on an axle incorporating a pair of bearing assemblies.

FIG. 9 shows the motor bell 18 and the drive collar 20 attached to each other. As shown in FIG. 9, the motor assembly 10 is adapted to allow the axle 44 to traverse the motor assembly 10. For illustration purposes, a plurality of bearing assemblies 50*a* and 50*b*, arranged in a spaced apart relationship with respect to each other, surround the particular section of the axle 44 that, during operation of the skateboard 17 (the transport vehicle) comprising the truck 16, is surrounded by the wheel 22. In the particular arrangement shown in the figures, there are a pair of angular contact ball bearings 50*a* and 50*b*. As shown in FIGS. 11 and 12, the bearings 50*a* and 50*b* are located within the passage traversing the wheel 22 and which will the axle 44 of the truck 16.

Figure 10:
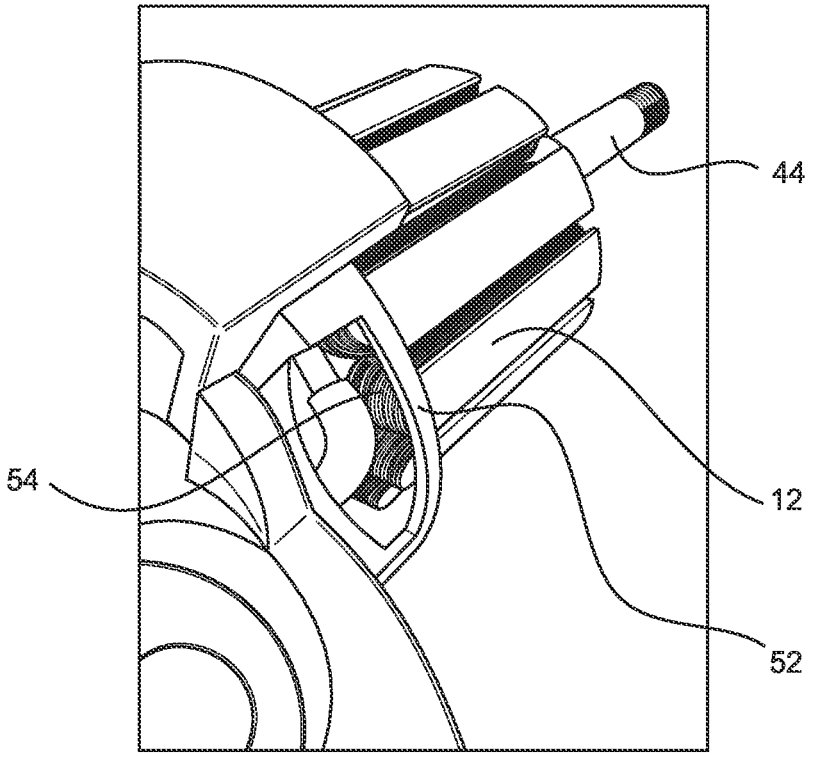
FIG. 10 is a top rear perspective view of the truck shown in FIG. 3 with one wheel and motor bell removed.

Referring now to FIG. 10, FIG. 10 is a rear view of the motor assembly 10 with the motor bell 18 and the drive collar 20 removed for illustration purposes. As shown in FIG. 10, the motor assembly 10 further comprises a rear plate 52.

Figure 14:
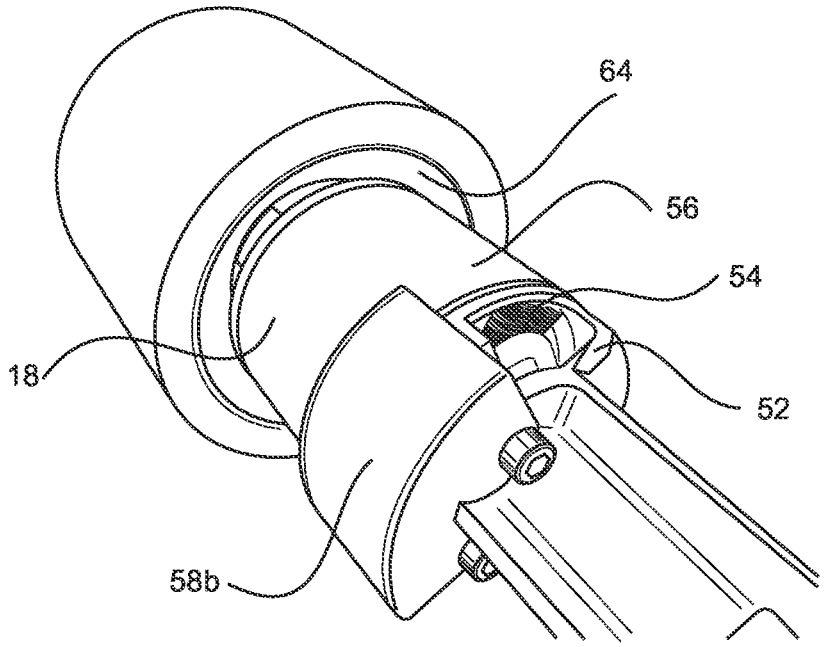
FIG. 14 is a perspective view of one side of the truck shown in FIG. 3.

The rear plate 52 comprises openings 54. The rear plate 52 is adapted to receive the outer end 56 of the motor bell 18 as shown in FIG. 14. The outer end 56 is a free end in the sense that it is not attached to any portion of the truck 16 permitting removal of the motor bell 18 when removing the wheel 22.

Figure 3:
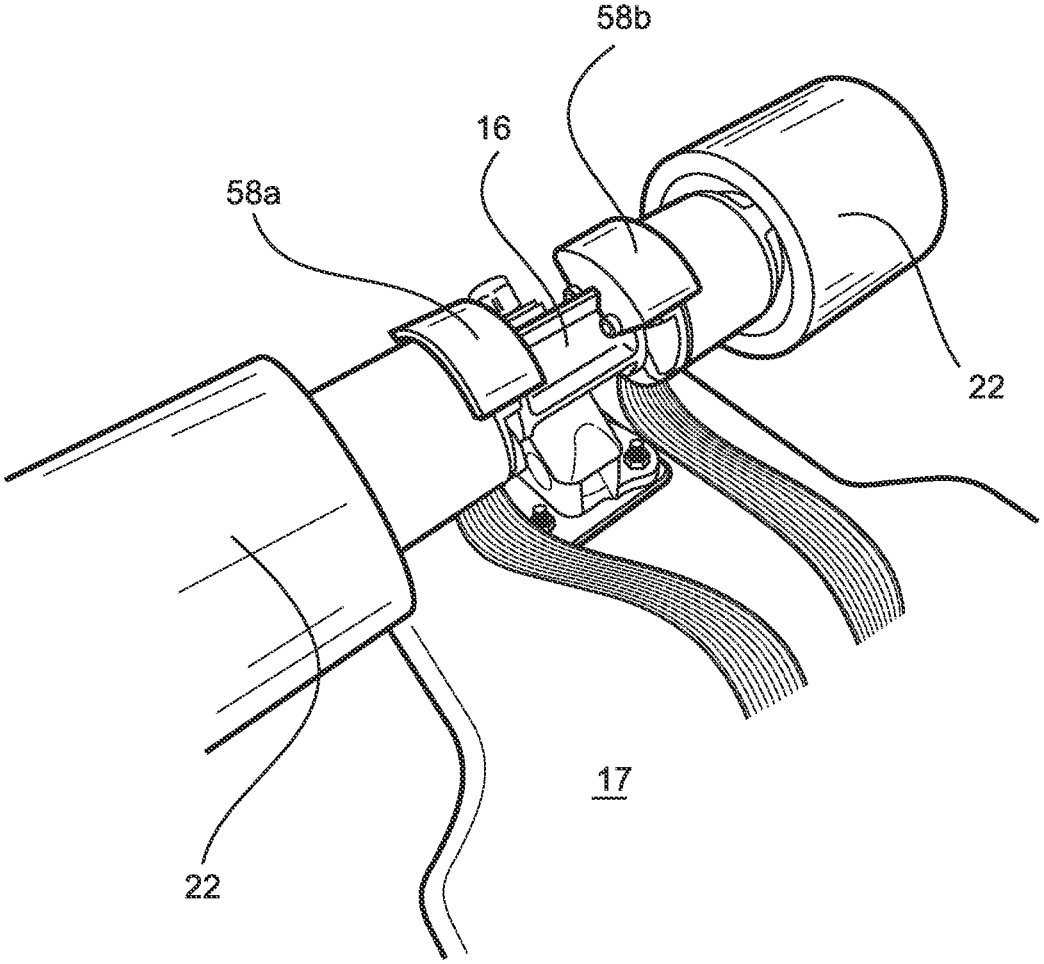
FIG. 3 is a top perspective view of a particular arrangement of a skateboard truck in accordance with the present embodiment of the invention for a direct drive system for skateboards.

Further, as shown in FIGS. 3 and 14, wedge-like stoppers 58*a* and 58*b* are attached to the hanger of the truck 16. The wedge-like stoppers 58*a* and 58*b* cover partially the location of the rear plate 52 that faces the road when the skate board is resting on the ground.

Referring now to FIGS. 11 to 17, FIGS. 11 to 17 show the process for mounting of the wheel 22 onto the truck 16.

FIG. 11 shows the inner end of a wheel 22. The inner end 22 comprises an indentation 60 defining a recessed surface 62 and a wall 64 surrounding the recessed surface 62. The indentation 60 is configured in such a manner to define inner surface of the wall 64 as a curved surface as shown in, for example, FIGS. 12 and 14.

FIG. 12 illustrates attachment of the inner collar 20 to the inner end of the wheel 22 by inserting the extensions 24 into apertures 26 shown in FIG. 11.

Subsequently, the wheel 22 (including the motor assembly 10) is mounted onto the axel 44 and moved such that the distal end 56 of the motor bell 18 is located adjacent the rear plate 52 as shown in FIG. 14.

Figure 15:
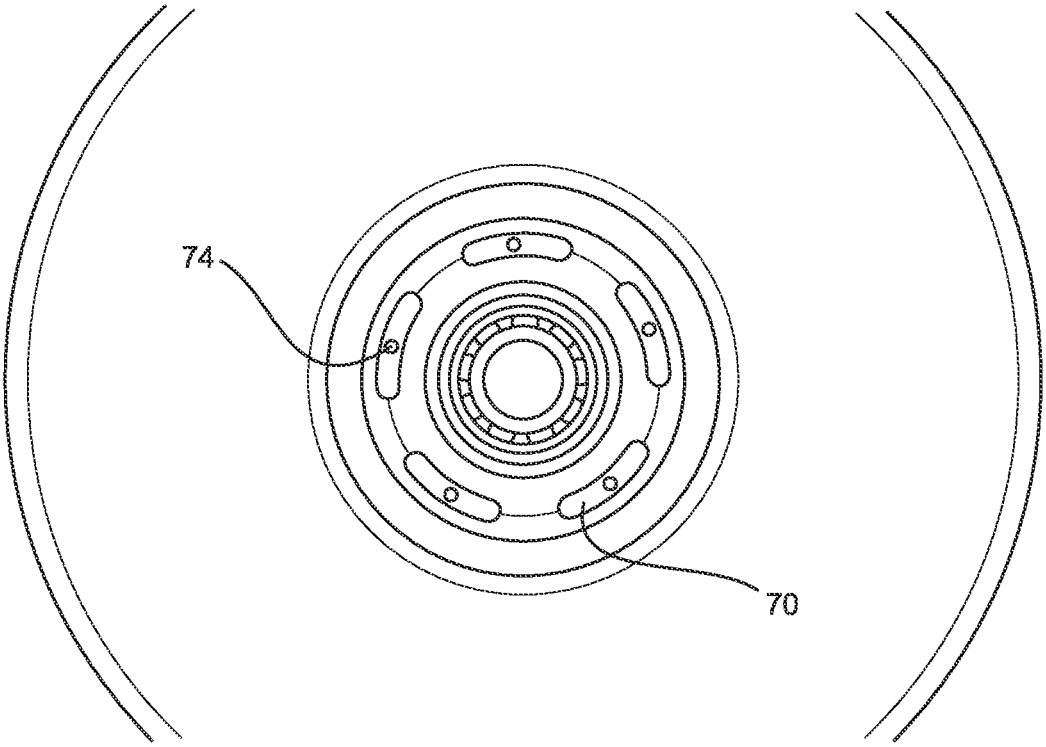
FIG. 15 is a plan view of the outer end of the wheel mounted the truck.
Figure 16:
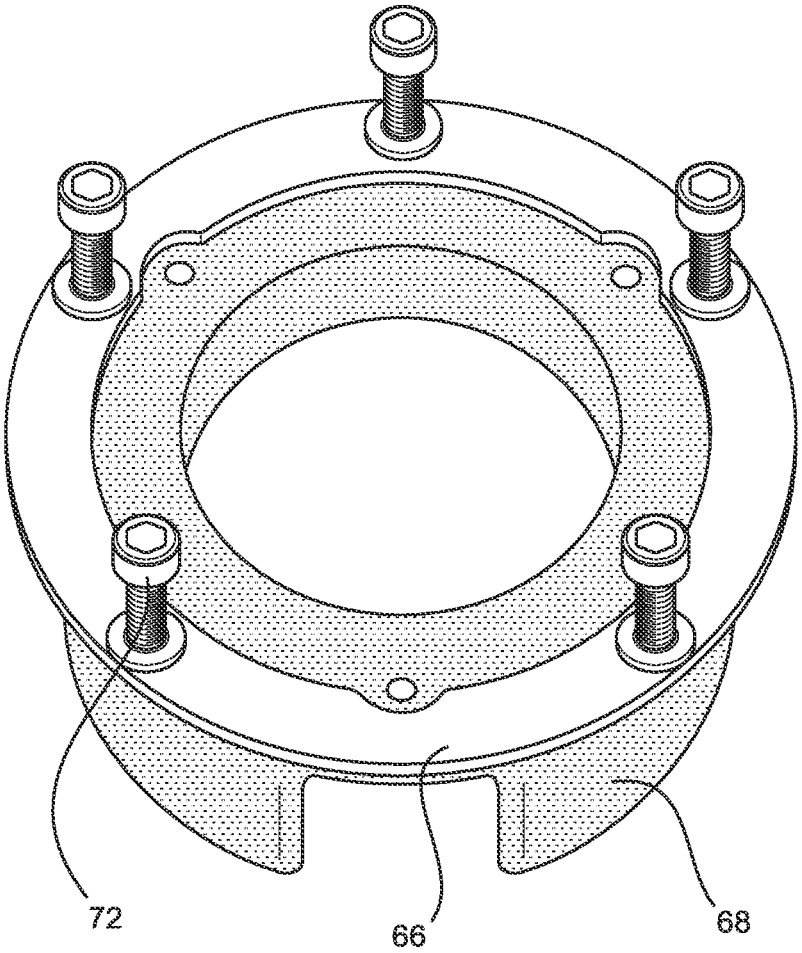
FIG. 16 is a top perspective of a fastening ring for attachment to outer end of wheel.
Figure 17:
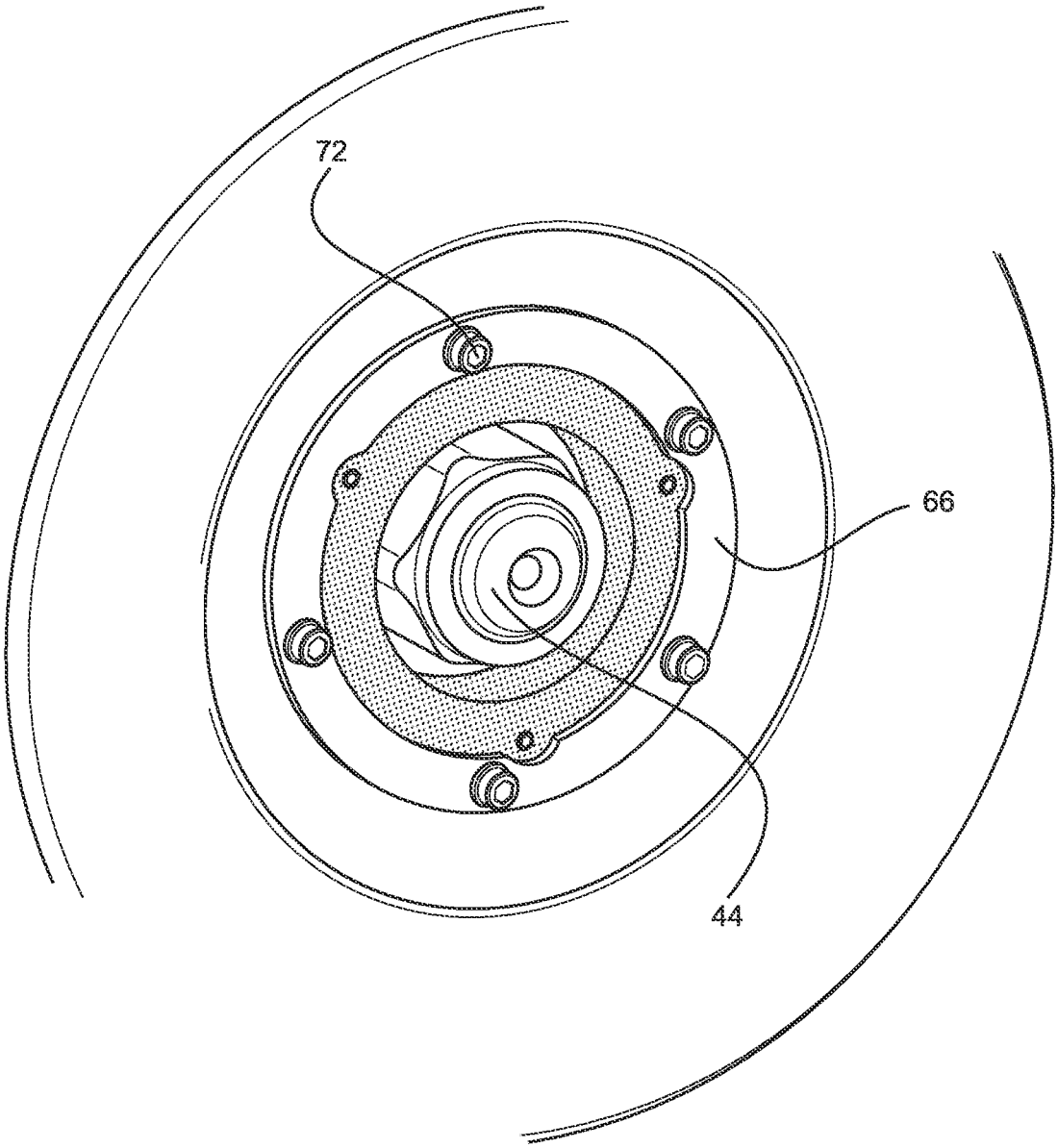
FIG. 17 is a plan view of the outer end of the wheel mounted the truck incorporating fastening ring shown in FIG. 17.

For operation of the skateboard 17, the wheel 22 needs to be secured to avoid the wheel 22 to detach from the axle 44. For this, as shown in FIGS. 15 to 17, there is provided a fastening ring 66 comprising extensions 68 arranged in a spaced apart relationship with respect to each other about the outer circumference of the fastening ring 66. The extensions 68 are adapted to be received in openings 70 (see FIG. 15) just as was described with reference to attachment of the drive collar 20 to the inner end of the wheel 22. Once the fastening ring 65 is mounted onto the outer end of the wheel, screws 72 are screwed into the extensions 68 such that the end of the screws 72 are screwed into the openings 74 (see FIGS. 15 and 9) of the extensions 24 of the drive collar 20. In this manner, the wheel 22 is secured to axel 44.

In operation, the fact that the motor bell 18 comprises an open end facing the indentation 60 of the wheel 22 and that the rear plate 52 (see FIG. 14) comprises openings 52 allows for airflow to occur within the motor assembly 10 (in particular through the motor bell 18) with the airflow being deflected by the curved surface defined by the inner surface of the wall 64 towards the outer surface of the motor bell 18. This airflow cools down the motor assembly 10 during operation of the skateboard.

Furthermore, as mentioned before, the drive collar 20 is attached to the wheel 22 as well as to the motor bell 18 via the fastening structure 32. In this manner a single motor assembly 10 is formed comprising the drive collar 20 being attached to the wheel 22 as well as to the motor bell 18; thus, removal of the wheel 22 results in removal of the motor bell 18. This permits in a single step removal of the wheel and the motor bell 18.

Modifications and variations as would be apparent to a skilled addressee are deemed to be within the scope of the present invention.

Further, it should be appreciated that the scope of the invention is not limited to the scope of the embodiments disclosed. These embodiments are intended for the purpose of exemplification only. Functionally equivalent products, formulations and methods are clearly within the scope of the invention as described herein.

Reference to positional descriptions, such as lower and upper, or inner and outer, are to be taken in context of the embodiments depicted in the figures, and are not to be taken as limiting the invention to the literal interpretation of the term but rather as would be understood by the skilled addressee.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprise", "comprises," "comprising," "including," and "having," or variations thereof are inclusive and therefore specify the presence of stated features, integers, steps, operations, elements, and/or components, but do not preclude the presence or addition of one or more other features, integers, steps, operations, elements, components, and/or groups thereof.

Although terms such as first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Throughout this specification, unless the context requires otherwise, the word "comprise" or variations such as "comprises" or "comprising", will be understood to imply the inclusion of a stated integer or group of integers but not the exclusion of any other integer or group of integers.

The invention claimed is:

1. A motor assembly for a transport vehicle having at least one wheel for rotating about a shaft having an end distal to the wheel and an end proximal to the wheel, the motor assembly comprising a stator fixed to the shaft, and a motor bell surrounding the shaft at the location of the stator, wherein the motor bell comprises a first end being adapted to be attached to the wheel for transferring rotational movement of the motor bell to the wheel, and a second end surrounding the shaft at the location of the end distal to the wheel, wherein the second end of the motor bell is a free end permitting removal of the motor bell during removal of the wheel, the first and second end of the motor bell comprise open ends permitting air flow therethrough, wherein the motor assembly further comprises a drive collar having a first end adapted to be attached to the first open end of the motor bell, and a second end adapted to be attached to the wheel.

2. A motor assembly according to claim 1 wherein the drive collar comprises a base plate and a plurality of extensions extending from the base plate, the base plate being adapted for attachment to the first end of the motor bell and the extensions being adapted to be attached to the wheel.

3. A motor assembly according to claim 1 wherein the drive collar is attached to the first end of the motor bell via a cap being adapted to permit air flow through the first end of the motor bell.

4. A motor assembly according to claim 3 wherein the cap comprises a base ring and a fastening structure adapted to permit airflow through the first end of the motor bell.

5. A motor assembly according to claim 4 comprising a first bearing assembly surrounding the shaft at the location of the joint of the fastening structure and the first end of the drive collar.

6. A motor assembly according to claim 5 wherein the fastening structure comprises an opening and the first end of the drive collar comprises another opening, the openings defining a passage for receiving the first bearing assembly.

7. A motor assembly according to claim 6 wherein the bearing assembly comprises a needle bearing assembly.

8. A motor assembly according to claim 5 further comprising a second bearing assembly surrounding the shaft at a location within the wheel.

9. A motor assembly according to claim 8 wherein the second bearing assembly comprises at least one angular contact ball bearings.

10. A motor assembly according to claim 1 wherein the transport vehicle comprises a skateboard comprising a truck having one or more shafts.

11. A motor assembly according to claim 1 wherein each shaft comprises one of the motor assemblies having a wheel attached thereto.

12. A motor assembly for a transport vehicle having at least one wheel for rotating about a shaft having an end distal to the wheel and an end proximal to the wheel, the motor assembly comprising a stator fixed to the shaft, and a motor bell surrounding the shaft at the location of the stator, wherein the motor bell comprises a first end being adapted to be attached to the wheel for transferring rotational movement of the motor bell to the wheel, and a second end surrounding the shaft at the location of the end distal to the wheel, wherein the second end of the motor bell is a free end permitting removal of the motor bell during removal of the wheel, wherein the motor assembly further comprises a rear plate being adapted to receive the second end of the motor bell, and the rear plate comprises openings to allow air flow therethrough.

13. A motor bell of a motor assembly for a transport vehicle having at least one wheel for rotating about a shaft having an end distal to the wheel and an end proximal to the wheel, the motor assembly comprising a stator fixed to the shaft, the motor bell surrounding the shaft at the location of the stator, wherein the motor bell comprises a first end being adapted to be attached to the wheel for transferring rotational movement of the motor bell to the wheel, and a second end surrounding the shaft at the location of the end distal to the wheel, wherein the second end of the motor bell is a free end permitting removal of the motor bell during removal of the wheel, wherein the first end comprises a cap being adapted to permit air flow through the first end of the motor bell and the cap comprising a fastening structure comprising an opening adapted to receive at least a portion of a bearing assembly, and the bearing assembly comprises a needle bearing assembly.

14. A transport vehicle having one or more shafts, and one or more motor assemblies having each one wheel for rotating about the shafts having an end distal to the wheel and a proximal end to the wheel, the motor assembly comprising a stator fixed to the shaft and a motor bell surrounding the shaft at the location of the stator, wherein the motor bell comprises a first end being adapted to be attached the wheel for transferring rotational movement of the motor bell to the wheel, and a second end surrounding the shaft at the location of the end distal to the wheel, wherein the second end of the motor bell is a free end permitting removal of the motor bell during removal of the wheel, the first and second end of the motor bell comprise open ends permitting air flow therethrough, wherein the motor assembly further comprises a drive collar having a first end adapted to be attached to the first open end of the motor bell, and a second end adapted to be attached to the wheel.

15. A transport vehicle according to claim 14 wherein the transport vehicle comprises a skateboard comprising a truck having at least one shaft.

* * * * *